United States Patent [19]

Rush

[11] Patent Number: 4,596,437

[45] Date of Patent: Jun. 24, 1986

[54] ELECTRICAL CONTACT ELEMENTS, CONNECTORS AND METHODS OF MANUFACTURE

[75] Inventor: Derek A. Rush, London, England

[73] Assignee: Smiths Industries Public Limited Company, London, England

[21] Appl. No.: 740,454

[22] Filed: Jun. 3, 1985

[30] Foreign Application Priority Data

Jun. 30, 1984 [GB] United Kingdom ..... 8416723

[51] Int. Cl.[4] ..... H01R 13/05

[52] U.S. Cl. ..... 339/221 R

[58] Field of Search ..... 339/220 R, 221 R, 221 M, 339/258 R, 258 P, 262 R, 252 P, 252 R

[56] References Cited

U.S. PATENT DOCUMENTS

| | | | |
|---|---|---|---|
| 2,036,759 | 4/1936 | Kleinmann | 339/252 P |
| 3,031,641 | 4/1962 | Camzi | 339/252 P |
| 3,381,262 | 4/1968 | Jeanrenaud | 339/258 R |
| 3,557,428 | 1/1971 | Bonhomme | 339/262 R |
| 3,634,819 | 1/1972 | Evans | 339/221 R |
| 3,743,979 | 7/1973 | Schor | 339/252 P |
| 4,534,611 | 8/1985 | Wohlfart | 339/258 R |

*Primary Examiner*—Gil Weidenfeld
*Assistant Examiner*—Gary F. Paumen
*Attorney, Agent, or Firm*—Pollock, Vande Sande & Priddy

[57] ABSTRACT

An electrical contact element for a backplane connector is of unitary construction. The element has a compliant portion of generally cylindrical shape with tapered ends and is formed with at least three radial slots equally spaced around the element, the slots intersecting one another within the element and extending axially along the element. The radial slots open into one another within the compliant portion and form three sector-shaped limbs that are urged inwards towards one another when the contact element is inserted into a plated hole in a circuit board. Below the compliant portion projects a narrower stem with flattened sides for a wire wrapped connection. The other end of the contact element is formed with a female mating portion in which may be mounted spring-wire contacts for engaging an inserted pin.

13 Claims, 6 Drawing Figures

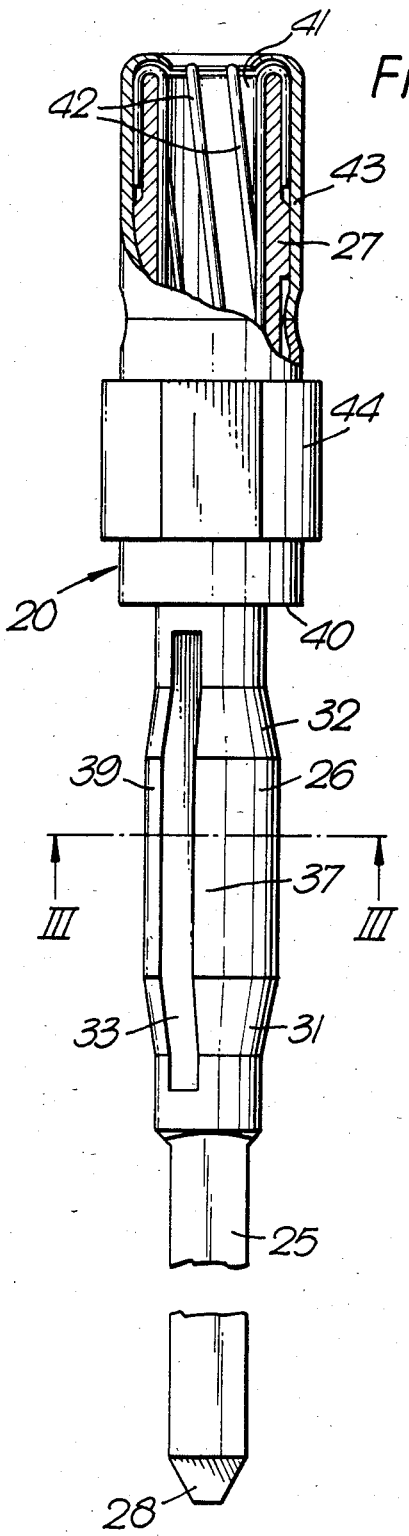
Fig. 2.
Fig. 3.
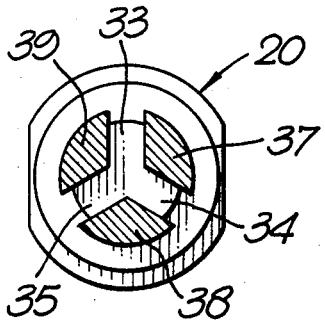
Fig. 4.
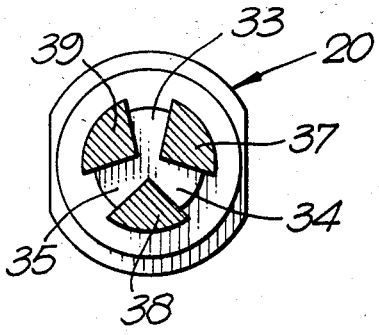

ELECTRICAL CONTACT ELEMENTS, CONNECTORS AND METHODS OF MANUFACTURE

BACKGROUND OF THE INVENTION

This invention relates to electrical contact elements, connectors and to methods of manufacture.

The invention is more particularly concerned with contact elements of the kind for insertion in a plated-through hole in a printed circuit board. Contact elements of this kind are used in connectors, one-half of which, the backplane comprises an array of contact elements in an insulative housing which sits on the circuit board and provides support and protection for the contact elements. Connection to another circuit board is made by means of the other half of the connector which is separate from the backplane but is arranged to mate with it.

The contact elements of such backplanes are generally made from a single piece of metal, one end of which projects into the hole in the circuit board and the other end of which mates with a cooperating contact element in the other half of the connector. In order to ensure a good mechanical and electrical engagement with the hole, that part of the contact element may be compliant across its width so that it is squeezed on insertion into the hole. Various different configurations of contact element have been devised in order to provide this compliance. In one form, the contact element is formed by machining to a generally cylindrical shape, then flattening a portion of the element out of which is subsequently punched a central slot extending lengthways of the element. That portion of the contact element in which the slot is formed provides a resilient section of the contact element since the opposite sides of the slot are urged resiliently towards one another on insertion in the hole. The manufacture of such a contact element requires several manufacturing steps which have to be performed by different machines, thereby increasing the cost of the contact element. Also, contact by the element with the hole is localized to opposite sides of the element rather than around the entire circumference of the element and the hole.

BRIEF SUMMARY OF THE INVENTION

It is one object of the present invention to provide an improved contact element which can be made accurately at low cost.

According to one aspect of the present invention there is provided an electrical contact element adapted for contacting the surface of an aperture in a planar member, the contact element being of unitary construction and having a compliant portion of generally cylindrical shape which is adapted for insertion within said aperture, wherein said compliant portion has formed therein at least three radial slots spaced around said portion and extending axially of the element, the slots opening into one another within said compliant portion so as to define at least three limbs that are urged compliantly inwards towards one another on engagement with said aperture.

The slots are preferably equally spaced around the element, and the compliant portion is tapered at each end to smaller diameters, the slots extending a part way at least along the tapered ends of said compliant portion. The slots may be narrower inwardly of the contact element. The contact element is preferably formed with a mating portion at one end adapted to receive a cooperating contact element. The mating portion may be a female member adapted to receive a cooperating contact pin member and, in this respect, the female member may include a plurality of spring wires arranged to engage the surface of said pin member. The mating portion and the compliant portion may be separated by a radially-extending annular shoulder. The contact portion is preferably formed with a shank portion at an end of said compliant portion, the shank portion having a smaller width than said compliant portion. The shank portion may have flattened sides and a tapered tip. The contact element may be made of beryllium copper or phosphor bronze.

According to another aspect of the present invention there is provided a method of manufacturing an electrical contact element of the kind adapted for contacting the surface of an aperture in a planar member, comprising the steps of forming in a unitary metal element a portion thereof of generally cylindrical shape for insertion within said aperture, and forming in said portion at least three radial slots spaced around said portion and extending axially of the element, the slots being arranged to open into one another within said portion so as to define at least three limbs that are urged compliantly inwards towards one another on engagement with said aperture.

The slots may be formed by cutting material from the cylindrical portion and may be cut using a rotating disc cutter.

According to a further aspect of the present invention there is provided a contact element made by a method according to the other aspect of the present invention.

According to an additional aspect of the present invention there is provided an electrical connector including a contact element according to the one or further aspect of the present invention.

The connector preferably includes an insulative housing within which the contact element is mounted, a part at least of the compliant portion of the contact element projecting from the housing. The connector may include an elongate insulative housing and a plurality of contact elements spaced apart along the housing.

According to one more aspect of the present invention there is provided an electrical connector assembly including a planar circuit board and an electrical connector according to the additional aspect of the present invention, the circuit board having an aperture therein formed with a conductive surface, and the compliant portion of the contact element extending through the aperture with each of the limbs in contact with the conductive surface.

A backplane connector including several contact elements, for an electrical circuit board, and a method of manufacturing the contact elements, in accordance with the present invention, will now be described, by way of example, with reference to the accompanying drawings.

BRIEF DESCRIPTION OF THE DRAWINGS

FIG. 2 is a partly cut-away enlarged side elevation of a contact element of the connector;

FIG. 3 is a transverse cross-section on the line III—III of FIG. 2;

FIG. 4 is a transverse cross-section on the same line as that of FIG. 3 but showing an alternative contact element.

DETAILED DESCRIPTION

Figure 1:
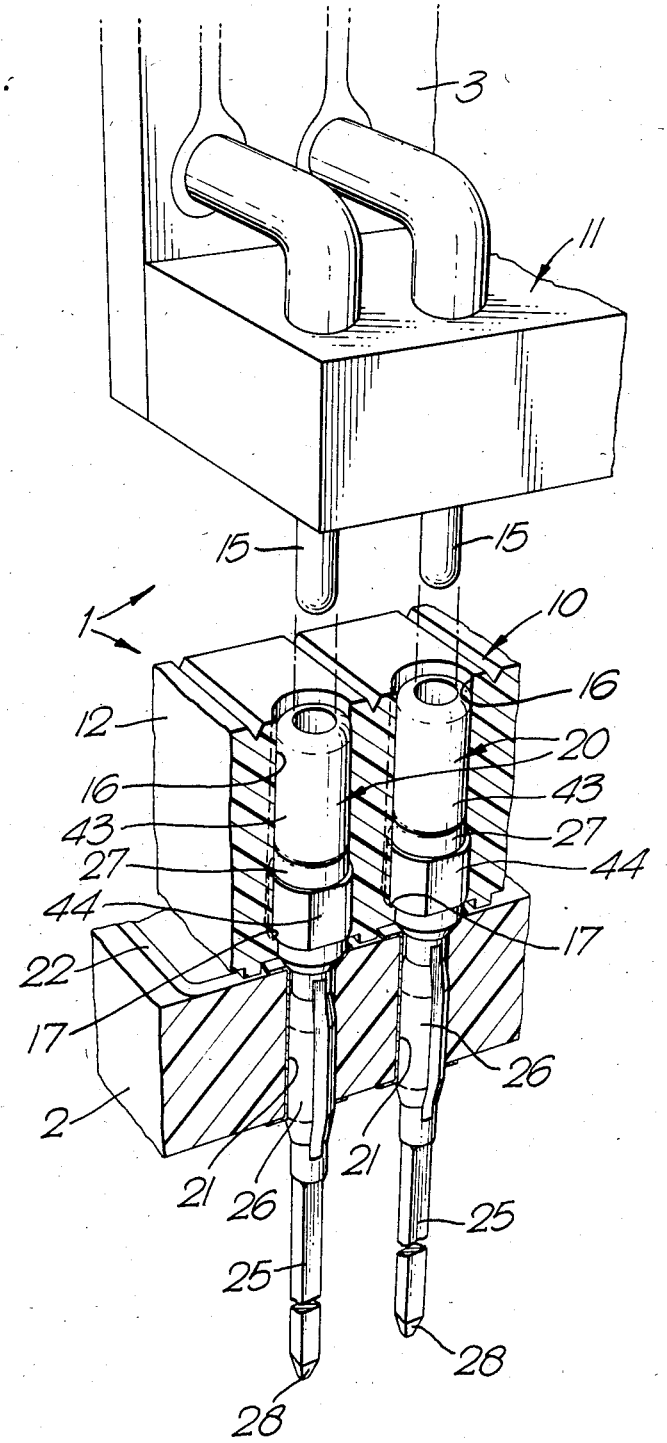
FIG. 1 is a perspective view showing the connector halves mounted on their circuit boards.

With reference to FIG. 1, the connector 1 comprises two mating halves, one-half 10 being mounted on the surface of a backplane printed circuit board 2, and the other half 11 being mounted on a daughter board 3. The two halves 10 and 11 of the connector 1 can be joined together to establish electrical connection of the daughter board 3 with the backplane board 2.

The backplane half 10 of the connector has a rectangular plastics housing 12 which supports and protects several vertical contact elements 20. The underside of the housing 12 sits directly on the upper surface of the board 2 with each contact element 20 extending through respective apertures 21 in the board. Each aperture 21 is plated through the thickness of the board 2 with a conductive layer that makes contact with a respective conductive track 22 formed on the upper or lower surface of the board, or on a layer within the board. These tracks 22 connect with the electrical circuit supported on the backplane.

The contact elements 20 will now be described in more detail with reference to FIGS. 2 and 3. Each contact element 20 is formed from a unitary piece of beryllium copper or phosphor bronze alloy which is about 19 mm long. The contact element has a lower shank portion 25, an intermediate compliant section 26, and an upper socket section 27.

The shank portion 25 is about 14 mm long and is provided with flat sides for wire wrapping purposes, being square in section at opposite ends, and about 0.63 mm across, smaller in width than the compliant section 26. At its lower end, the shank has a tapering tip 28 with a square end about 0.13 mm across.

At its upper end, the shank 25 joins with the intermediate section 26 which is about 4 mm long. The intermediate section 26 is of barrel shape, that is, it has a central generally cylindrical region that tapers at its lower end 31 and upper end 32 to smaller diameters. The intermediate section 26 has three elongate slots 33 to 35 that extend radially and are equally spaced around the section 26 at 120 degree intervals. The slots 33 to 35 open into one another centrally, to form a generally inverted 'Y' shape region in cross section, and extend lengthwise along the intermediate section. The slots 33 to 35 divide the intermediate section 26 into three limbs 37 to 39 which are of generally sector shape in section. The spacing between each limb 37 to 39, formed by the slots 33 to 35, enables them to be resiliently deflected towards one another making the intermediate section 26 compliant radially. The slots 33 to 35 shown in FIG. 3 have parallel faces; they could alternatively taper inwardly in the manner shown in FIG. 4.

At its upper end, the intermediate section 26 joins with the upper section 27 which has a larger diameter than the intermediate section and is separated from it by an annular shoulder 40. The upper section 27 is cylindrical in shape and of circular section. The lower end of the upper section 27 is closed while the upper end is open enabling access to its interior 41. Six spring metal wires 42 are retained in the interior 41 of the upper section 27 by an outer sleeve 43. The wires 42 extend at an angle to the longitudinal axis of the upper section 27 close to its inner surface and provide a spring contact socket for receiving a cooperating pin member 15 in the upper half 11 of the connector 1. A ring 44 embraces the upper section 27 close to its lower end.

Each contact element 20 is mounted in respective recesses 16 in the housing 12 such that the shank section 25 and compliant section 26 project vertically downwards through the floor of the housing, with the ring 44 locating on an annular shoulder 17 at the lower end of the recess 16, and with the socket section 27 projecting upwardly.

In operation, the tip 28 of the shank 25 serves to guide the contact element 20 through the aperture 21 in the circuit board 2. As the backplane half 10 of the connector is pushed further down onto the board 2 the compliant section 26 enters the aperture 21. The diameter of the compliant section 26 is chosen to be slightly larger than the diameter of the aperture 21 in the board such that the limbs 37 to 39 are deflected inwardly, their resilience ensuring a good mechanical and electrical contact with the aperture. Electrical contact is thereby established with the plating on the aperture at several locations around the circumference. The lower, shank portion 25 projects from the lower surface of the board 2. Electrical contact can be made to the shank by wire wrapping.

Figure 5:
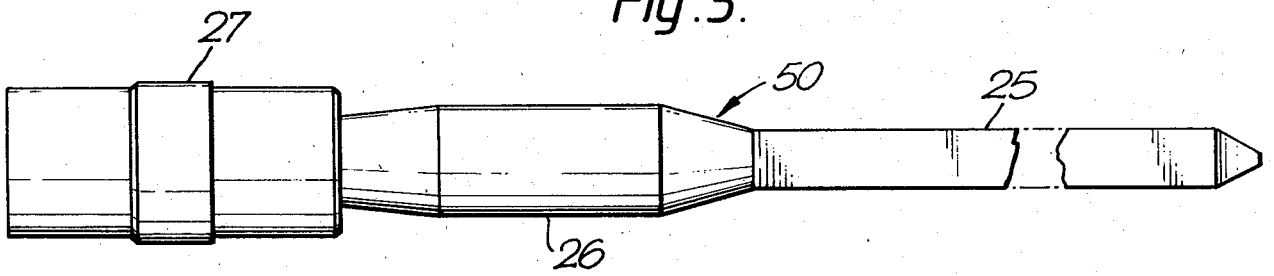
FIGS. 5 and 6 show steps in manufacture of the contact element.
Figure 6:
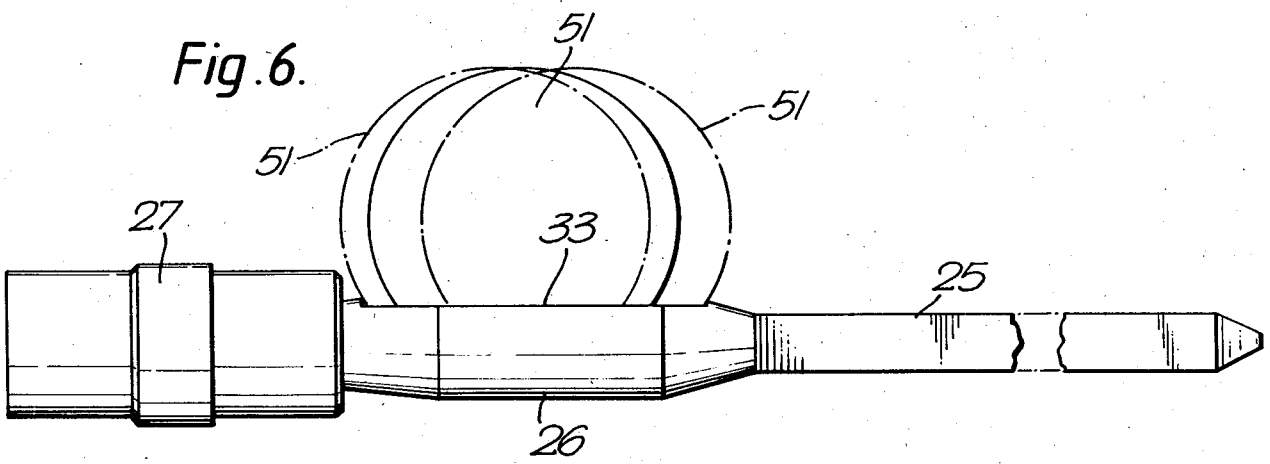

The method of manufacture of the contact elements will now be described with reference to FIGS. 5 and 6. A blank 50 of the form shown in FIG. 5 is first formed by a conventional turning and milling operation. This produces accurately controlled dimensions for the outer surface of the contact element, and for the interior of the socket. On the same machine, the slots 33 to 35 are cut using a circular disc cutter 51, in the manner shown in FIG. 6. The edge of the cutter 51 is brought down on the center of the intermediate section and moved up and down the blank to produce a slot 33 of the desired length. The blank is then rotated by angles of 120 degrees to enable the other two slots to be produced. Where tapered slots, of the kind shown in FIG. 4, are required, the disc cutter will taper in thickness radially, being thinner at its edge.

In this way, the shape and dimensions of the resilient limbs 37 to 39 can be made at low cost with a high accuracy, thereby ensuring a good contact is established with the apertures.

The spring wires 42, the outer sleeve 43 and the ring 44 are readily assembled subsequently.

It will be appreciated that the contact element can be made in different ways and that it can take different forms without departing from the invention. For example, instead of the contact element having a socket at its upper end it could be provided with a pin that mates with a socket in the other half 11 of the connector. Also it would be possible, for example to form four compliant limbs in the intermediate section by using four slots which intersect one another to define an "X" shaped central region in cross section rather than the "Y" shaped central region shown in FIGS. 3 and 4. Such "X" and "Y" shaped central ragions, formed by intersecting radial slots, are referred to in the appended claims as "cruciform" in shape.

What I claim is:

1. An electrical contact element of the kind having a generally one-piece cylindrical compliant portion shaped for insertion within and for contact with the surface of an aperture in a planar member, the improvement wherein, said compliant portion has formed therein at least three radial slots spaced around said portion, said radial slots extending into said one-piece cylindrical member in intersecting relation to one another so as to define a central recess within said compliant portion formed entirely by said radial slots, said radial slots and the outer arcuate surface of said cylindrical member further defining at least three limbs of sector shape in section that are urged compliantly inwards towards one another and toward the intersection of said radial slots.

2. An electrical contact element according to claim 1, wherein said slots are equally spaced around the solid cylindrical member.

3. An electrical contact element according to claim 14, wherein the said compliant portion is tapered at each end to smaller diameters, and wherein the said slots extend a part way at least along the tapered ends of said compliant portion.

4. An electrical contact element according to claim 1, wherein the said slots are narrower inwardly of the contact element.

5. An electrical contact element according to claim 1, wherein the said contact element is formed with a mating portion at one end, and wherein said mating portion is shaped to receive a cooperating contact element.

6. An electrical contact element according to claim 5, wherein the said mating portion is a female member shaped to receive a cooperating contact pin member.

7. An electrical contact element according to claim 6, wherein the said female member includes a plurality of spring wires arranged to engage the surface of said pin member.

8. An electrical contact element according to claim 1, wherein the said contact element is formed with a shank portion at an end of said compliant portion, said shank portion having a smaller width than said compliant portion.

9. An electrical contact element for contacting a conductive surface of an aperture in a planar member, the element comprising a mating portion at one end of the contact element; a unitary solid cylindrical member which defines an intermediate compliant portion of the element, said compliant portion being tapered at one end and having at least three radial slots spaced around said compliant portion and extending axially along the element, the slots opening into one another within said compliant portion to define a central recess formed entirely by said slots and at least three limbs of sector shape in cross section; and a shank portion at the other end of the contact element, the shape of the element being such that when the compliant portion is inserted within the aperture, each limb contacts the conductive surface of the aperture, with the shank portion projecting below the planar member and the mating portion located above the planar member.

10. In combination, a circuit board, an electrical connector which makes connection to the circuit board, the circuit board having apertures therein with conductive surfaces, the connector comprising an insulative housing and a plurality of contact elements mounted therein, each said contact element comprising: a mating portion at one end of the contact element within the housing; a unitary solid member of generally cylindrical shape and tapered at one end, said cylindrical member defining an intermediate compliant portion of said contact element, the said compliant portion having at least three radial slots spaced around said compliant portion and extending axially along said contact element, the slots opening into one another within said compliant portion to define a central recess formed entirely by said slots and at least three limbs of sector shape that engage the said conductive surface of said aperture; and a shank portion at the other end of the contact element projecting through the aperture below the circuit board.

11. An electrical connector assembly including a circuit board having a plurality of apertures therein with a conductive surface, and an electrical connector comprising an insulative housing within which are mounted a plurality of contact elements that make connection with the said conductive surface of said apertures, wherein each said contact element comprises a mating portion at one end of the contact element a unitary solid member of generally cylindrical shape which defines an intermediate compliant portion of said contact element having at least three radial slots spaced around said compliant portion and extending axially along said contact element, the slots opening into one another within said compliant portion to define central recess formed entirely by said slots and at least three limbs that are sector shaped in cross section and engage the said conductive surface of said aperture; and a shank portion at the other end of the contact element projecting through the aperture below the circuit board.

12. A method of manufacturing an electrical contact element for contacting the surface of an aperture in a planar member, comprising the steps of: forming in a unitary solid metal element a portion thereof of generally cylindrical shape for insertion within said aperture, and forming in said portion at least three radial slots spaced around said portion and extending axially of the element, the slots opening into one another within said portion so as to define a generally cruciform central recess formed entirely by said radial slots and at least three limbs of sector shape that are urged compliantly inwards towards one another on engagement with said aperture.

13. A method according to claim 12, wherein the said slots are formed by cutting material from said cylindrical portion of said solid metal element.

* * * * *